United States Patent [19]

Noya

[11] Patent Number: 5,044,941

[45] Date of Patent: Sep. 3, 1991

[54] FLUIDIZED BED SYSTEM

[75] Inventor: Takeo Noya, Kanagawa, Japan

[73] Assignee: Babcock-Hitachi Kabushiki Kaisha, Tokyo, Japan

[21] Appl. No.: 208,459

[22] Filed: Jun. 20, 1988

[30] Foreign Application Priority Data

Oct. 23, 1985 [JP] Japan ..... 237065/85

[51] Int. Cl.[5] ..... F23G 7/00

[52] U.S. Cl. ..... 432/58; 110/245; 432/14; 432/15

[58] Field of Search ..... 431/7, 170, 328; 110/243-245, 263; 422/311, 141-146; 165/104.16; 432/14, 15, 58

[56] References Cited

U.S. PATENT DOCUMENTS

| | | | |
|---|---|---|---|
| 3,042,498 | 7/1962 | Norman | 422/143 |
| 4,052,140 | 10/1977 | Highley | 431/7 |
| 4,335,661 | 6/1982 | Stewart et al. | 110/245 |
| 4,338,283 | 7/1982 | Sakamoto et al. | 431/170 |
| 4,400,150 | 8/1983 | Smith et al. | 110/245 |
| 4,434,726 | 3/1984 | Jones | 110/245 |
| 4,436,507 | 3/1984 | Stewart et al. | 431/170 |
| 4,445,844 | 5/1984 | Matthews | 431/170 |
| 4,517,162 | 5/1985 | Moss | 431/170 |
| 4,526,111 | 7/1985 | Mischke | 110/245 |
| 4,628,831 | 12/1986 | Delessard et al., | 110/245 |

*Primary Examiner*—Henry C. Yuen

*Attorney, Agent, or Firm*—Antonelli, Terry, Stout & Kraus

[57] ABSTRACT

A fluidized bed system comprises at least three cells constituting a fluidized bed. One of the cells interposed between other cells may function as a non-fluidized bed cell in response to the operating condition of the system.

10 Claims, 1 Drawing Sheet

FLUIDIZED BED SYSTEM

This is a division of application Ser. No. 922,349, filed Oct. 23, 1986, abandoned.

BACKGROUND OF THE INVENTION

This invention relates to a fluidized bed system in which bed material, such as coal, coal ash, limestone, cement clinker or sand, is burned, gasified or dryed by being fluidized.

In the conventional fluidized bed system, a plurality of fluidized bed cells of which operational conditions are different from each other are formed by providing partition plates. Usually, in the system, temperature is raised to 500°-1000° C., so that the partition plate has inevitably been complex in construction and high in cost because of the need to withstand the high temperature. Also, provision of a partition plate has made the fluidized bed system unable to meet various different operating conditions. In other words, the system does not have a wide use.

In a fluidized bed combustion system for burning, for example, coal or coal ash, it has hitherto been usual practice to keep the temperature of the fluidized bed in the range between 800° and 1000° C. to burn a fuel, such as coal, for reasons stated hereinafter.

(1) Burning the fuel at a high temperature of over 1000° C. produces oxides of nitrogen (NOx) as the bonding of nitrogen to oxygen contained in the air used for combustion takes place. When the concentration of NOx emissions in the flue gas rises, the atmosphere is polluted and this would give rise to a problem with regard to environmental disruption.

(2) When a fuel of high sulfur content is burned, it is now usual practice to mix the bed material with limestone particles to remove sulfur oxides (SOx). To enable this desulfurization reaction effectively requires maintaining the temperature of the fluidized bed in the range between 850° and 1000° C.

When particles of coal or EP ash (ash collected by electric dust collectors) are burned in a fluidized bed, fuel particles of small diameter are scattered by gas, such as air, for achieving fluidization of the bed material, and fly to a hollow body above the fluidized bed, with the result that such fuel particles are conveyed to the flue by exhaust gases of combustion before they are fully combusted. Fuel particles of relatively large diameter are broken down to small particles by combustion in the fluidized bed. However, with the temperature of the fluidized bed being at a relatively low level of 800° to 1000° C., the fuel particles are conveyed to the flue by the exhaust gases of combustion through the hollow body before being burned to the core of each particle.

Thus exhaust gas from fluidized bed combustion systems contains ash of high non-combusted fuel component. Accordingly, the present practice is to separate the ash content of flue gas by a cyclone dust collector and to feed the separated ash into a re-combustion furnace of the fluidized bed system maintained at a high temperature of about 1100° C. so as to achieve a complete combustion of the non-combusted fuel components contained in the ash to turn the same into ash of the type that can be utilized as fly ash. FIG. 2 shows one example of the system for re-combusting the non-combusted fuel components. The system comprises a furnace 1 of a main combustion chamber, a cyclone dust collector 2 for collecting solid masses of ash released from the main combustion chamber, an air heater 3 for supplying combustion gas of high temperature to a start-up wind box 4, when the main combustion chamber is started up, to heat bed material above the wind box 4, a wind box 5 for the main combustion chamber, heat transfer tubes 6 located in a fluidized bed 6 in the main combustion chamber, a furnace 7 of a re-combustion chamber for re-combusting solid masses of ash containing non-combusted fuel components released from the main combustion chamber and collected by the cyclone dust collector 2, a cyclone dust collector 8 for collecting ash released from the re-combustion chamber, an air heater 9 having the same function as the air heater 3 used when the main combustion chamber is started up and used when the re-combustion chamber is started up, a wind box 10 for the re-combustion chamber for supplying air for combustion to set in motion bed material forming a fluidized bed 11*a* and to achieve a complete combustion of the solid masses of ash containing non-combusted fuel components which are supplied to the fluidized bed 11*a*, an ash transporting tube 12 for transporting the solid masses of ash containing non-combusted fuel components collected by the cyclone dust collector 2 and feeding the same into the fluidized bed 11*a* through ash feeding nozzles 13 and an exhaust duct 14 for releasing exhaust gases to the atmosphere.

When coal is used as a fuel, for example, in the fluidized bed combustion system of the aforesaid construction, costs are high because it is necessary to use an additional fluidized bed combustion system for collecting and re-combusting solid masses of ash containing non-combusted fuel components.

SUMMARY OF THE INVENTION

An object of the present invention is to provide a fluidized bed system having a wide use and capable of varying the size and/or number of a plurality of cells formed in the system in response to the condition of the operation of the system.

The other object of the invention is to provide a fluidized bed burning system having wide use which is capable of varying the size and/or number of main cell and start-up cell in a furnace in response to the operational condition.

Another object is to provide a fluidized bed combustion system which, eliminates the need to provide an additional fluidized bed combustion system for re-combustion ash containing non-combusted fuel components, is capable of achieving a perfect combustion of the fuel, such as coal, so that the flue gas released to the atmosphere contains no non-combusted fuel components.

The fluidized bed system according to the invention is characterized by having at least three cells constituting a fluidized bed of which the cell interposed between other cells can be made to function as a non-fluidized bed cell in response to the operating condition.

The fluidized bed combustion system according to the invention is characterized by comprising a main combustion cell, a start-up cell, a plurality of partition cells interposed between the main combustion cell and start-up cell, each partition cell capable of serving temporarily as a start-up cell or combustion cell in response to the operating condition, a dust collector for collecting solid masses of ash containing non-combusted fuel components from gases produced by combustion and released from a combustion section of a fluidized bed and an ash transporting tube connecting the dust collector to the start-up cell for re-combusting the solid masses of ash.

DETAILED DESCRIPTION OF THE PREFERRED EMBODIMENTS

Figure 1:
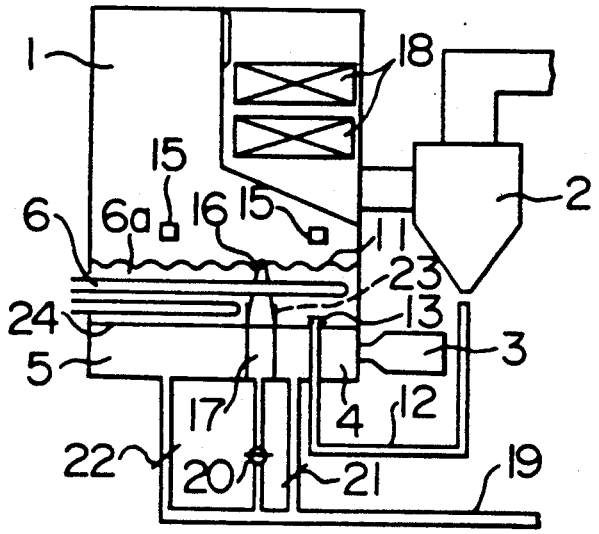
FIG. 1 is a schematic view of the fluidized bed combustion system showing an embodiment of a fluidized bed system according to the invention.
Figure 2:
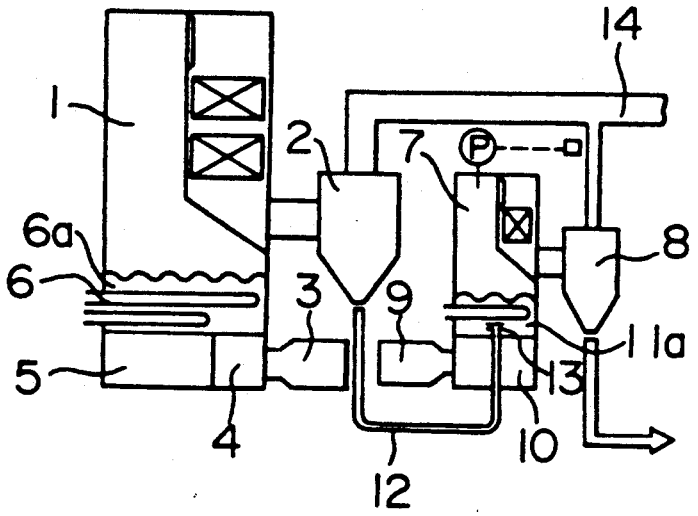
F I G. 2 PRIOR ART
FIG. 2 is a schematic view of a fluidized bed combustion system of the prior art

The invention will now be described by referring to a fluidized bed combustion system by way of example. A furnace designated by the reference numeral 1 is formed at its bottom portion with three cells constituting a fluidized bed, which are a start-up cell 11 for starting up the combustion system, a main combustion cell 6*a* for burning a fuel, such as coal, and a partition cell 16 interposed between the main combustion cell 6*a* and start-up cell 11. Wind boxes 4, 5 and 17 are located under the cells 11, 6*a* and 16 respectively for feeding a gas, i.e., air in this embodiment, into the respective cells for setting bed material, such as a fuel, in the cells in motion until the bed material reaches a state of high turbulence. The wind boxes 4, 5 and 17 are independent of each other and are maintained in communication with respective cells through a distributor plate 24 formed of porous plate, and are connected through an air duct 19 to a blower, not shown. Air dampers 20, 21 and 22 are each mounted in one of branch air ducts connecting the wind boxes 4, 5 and 17 to the air duct 19 for regulating the amount of air fed into the respective wind boxes. An air heater 3 for feeding a hot blast of air of high temperature into the wind box 4 for the start-up cell 11 when the combustion system is started up is connected to the wind box 4. Located in the fluidized bed are heat transfer tubes 6 and evaporators or super heaters for removing heat from the fluidized bed which are reduced in number in the start-up cell 11 to economize on fuel for the air heater 3 when the combustion system is started up. A heater assembly 18 including a superheater and an economizer is located in a flue in a rear portion of the furnace 1 for heating exhaust gases. Located also in the flue is a cyclone dust collector 2 for collecting solid masses of ash containing non-combusted fuel components from the exhaust gases in the flue which is connected through the ash transporting tube 12 to ash feeding nozzles 13 opening in the start-up cell 11. A feed nozzle 15 is opened in an upper portion of each of the cells 11, 6*a* and 16.

An operation will be described. When starting, the air damper 21 is opened to supply air to the start-up cell 11 via the wind box 4. So as to set the bed material, for example, limestone on the distributor plate 24 in motion. At the same time, heated air is fed from the air heater 3 to the start-up cell 11. When the bed material (limestone) reaches at a predetermined temperature, the coal is supplied into the start-up cell from the feed nozzles 15 and, firstly, the start-up cell is self-burned. Then, the main combustion cell 6*a* and the partition cell 16 are operated in turn. Subsequently, the air damper 20 is closed so that no air is fed to the wind box 17 for the partition cell 16 which is interposed between the wind box 4 for the start-up cell 11 and the wind box 5 for the main combustion cell 6*a*. As a result, the coal in the partition cell 16 remains deposited on the distributor plate 24 without moving. In other words, the fluidized bed in the lower portion of the furnace 1 is split by the stack of bed material in the partition cell 16 into a main combustion fluidized bed section and a start-up fluidized bed section. Gases containing non-combusted fuel components are exhausted from the main combustion cell 6*a* and flow through the flue to heat the heater assembly 18 before being led to the dust collector 2 which collects solid masses of ash containing non-combusted fuel components from the exhaust gases and feeds the same into the start-up cell 11 through the ash transporting tube 12 and ash feeding nozzles 13. Since the start-up cell 11 is separated from the main combustion cell 6*a* by the partition cell 11, it is possible to operate the start-up cell 11 in a condition which is distinct from the condition of operation of the main combustion cell 6*a*, i.e., at a temperature of 1100° C. which is higher than the temperature in the main combustion cell 6*a*. As described hereinabove, the heat transfer tubes 6 are smaller in number in the start-up cell 11 than in other cells 6*a* and 16, so that temperature inevitably becomes higher in the start-up cell 11 than in other cells 6*a* and 16 during operation. This advantageously enables the solid masses of ash containing non-combusted fuel components to be burned in the start-up cell 11, thereby eliminating the need to provide an additional fluidized bed combustion system for re-combusting the solid masses of ash.

When the coal used as a fuel is of the type which is so high in combustibility that the ash obtained by burning such coal contains no non-combusted fuel components, the ash collected by the dust collector 2 is delivered to a destination outside the system and the start-up cell 11 and partition cell 16 are used as combustion cells. In this case, the coal is supplied to the start-up cell 11 and partition cell as a fuel and at the same time the air damper 20 is opened to feed air into the wind box 17 for the partition cell 16, so as to set in motion the coal in the partition cell 16. In short, all the coal in all the cells are set in motion and brought to a state of high turbulence and rapid mixing, to burn the same effectively.

When the coal used as a fuel is of the type which produces solid masses of ash containing non-combusted fuel components whose amount is not large enough to warrant re-combustion of the ash in the start-up cell 11 at all times during operation, the start-up cell 11 and partition cell 16 are first operated as coal burning cells while the ash collected by the dust collector 2 is temporarily stored in a tank, not shown. When the amount of the collected ash has reached a level which enables the operation of the start-up cell 11 as a re-combustion cell to be continuously performed for a predetermined period of time, the ash stored in the tank is fed into the start-up cell 11 to burn the non-combusted fuel components therein. When the collected ash becomes empty, the start-up cell 11 is used again as a coal burning cell. When the ash stored in the tank has increased in amount again, the start-up cell 11 is changed into a re-combustion cell again. By performing the operation in which the start-up cell 11 temporarily functions as a re-combustion cell as described hereinabove, it is possible for the fluidized bed combustion system to handle any one of different types of coal as a fuel and to achieve a perfect combustion of the non-combusted fuel components in the ash by burning the ash at a high temperature. This is conducive to increased fuel efficiency of the system.

In another embodiment of the invention, the fluidized bed combustion system may be provided with a plurality of partition cells so that one of the partition cells adjacent the start-up cell may be used as an additional start-up cell when the coal used as a fuel is of the type which produces a large amount of solid masses of ash containing non-combusted fuel components. The start-up cell may be used for re-combusting the non-combusted fuel components in the ash when the coal used is of the type which produces a small amount of ash in the form of solid masses while letting the partition cell adjacent the start-up cell perform its original function of partitioning and using another cell adjacent the main combustion cell as an ordinary coal burning cell. By this arrangement, it is possible to eliminate the need to use a tank for temporarily storing the ash in the form of solid masses or to reduce the size of such tank. In short, by using a plurality of partition cells temporarily as a start-up cell and a combustion cell in response to the operating condition, it is possible to provide the fluidized bed system with wide use which greatly increases the usefulness of the system.

When the partition cell 16 is small in width as shown in FIG. 1 or when the speed of the hollow body is so high during operation that it is impossible to satisfactorily effect partitioning of the bed by the bed material, a partition plate may be mounted to extend from a portion of the distributor plate 24 located at the top of the wind box 17 for the partition cell 16 into the fluidized bed. This ensures that the bed material is positively deposited on the distributor plate 24.

In the embodiment shown and described hereinabove, the air fed into the wind boxes 4, 5 and 17 has been described as being supplied via the common air duct 19. However, the invention is not limited to this specific form of the embodiment and each wind box may be connected to a separate source of gas supply to feed a different type of gas to each wind box. Also, it is possible in the invention to vary the air ratio, i.e., the ratio of actual air volume to theoretical air volume for each cell.

In the embodiment shown and described hereinabove, the fluidized bed system has been described as having application in a fluidized bed combustion system. However, the invention is not limited to this specific form of the embodiment and the fluidized bed system according to the invention also has application in a system designed to dry bed material or gasify same.

What is claimed is:

1. A method for operating a fluidized bed combustion comprising a furnace, a distributor plate supported in said furnace, bed material supported on said distributor plate, and a plurality of wind boxes arranged side by side below said distributor plate for feeding fluidizing gas through portions of said distributor plate into corresponding portions of said bed material, each of said wind boxes having a gas damper; said method comprising:

closing at least one of the wind boxes by closing its associated damper so that a bed material portion extending above said closed wind box remains in a deposited condition on said distributor plate and simultaneously opening the other wind boxes by opening their associated dampers so that bed material portions extending above said opened wind boxes are fluidized, said closed wind box being arranged so that said deposited bed material acts to separate said furnace into a plurality of fluidized bed zones; and operating said plurality of fluidized bed zones at different operating conditions, respectively.

2. A method as claimed in claim 1, wherein there are two fluidized bed zones and one is operated as a start-up zone and the other is operated as a main combustion zone.

3. A method as claimed in claim 1, further comprising altering wind boxes to be closed to vary the size of the plurality of fluidized bed zones in response to operation conditions.

4. A method for operating a fluidized bed combustion comprising a furnace, a distributor plate supported in said furnace, bed material supported on said distributor plate, and a plurality of wind boxes arranged side by side below said distributor plate for feeding fluidizing gas through portions of said distributor plate into corresponding portions of said bed material, each of said wind boxes having a gas damper; said method comprising:

closing one of the wind boxes exclusive a wind box disposed at each end of the arrangement of the wind boxes by closing its associated damper so that a bed material portion extending above said closed wind box remains in a deposited condition on said distributor plate; and simultaneously opening the other wind boxes by opening their associated dampers so that bed material portions extending above said opened boxes are fluidized, such that said furnace is separated into two fluidized bed zones;

operating one of said fluidized bed zone as a start-up zone and the other fluidized bed zone as a main combustion zone;

then opening said closed wind box by opening the associated damper to fluidize the bed material portion extending thereabove; and operating the whole furnace as the main combustion zone.

5. A method for operating a fluidized bed combustion comprising a furnace, a distributor plate supported in said furnace, bed material supported on said distributor plate, and a plurality of wind boxes arranged side by side below said distributor plate for feeding fluidizing gas through portions of said distributor plate into corresponding portions of said bed material, each of said wind boxes having a gas damper; the method comprising:

opening the damper associated with the wind box at one end of the distributor plate, and supplying air to said end of the distributor plate so as to provide a start-up cell in which the bed material is fluidized;

supplying heated air to said start-up cell;

supplying fuel to be burned to said start-up cell;

burning said fuel supplied to said start-up cell;

opening the dampers associated with the wind boxes adjacent the wind box for supplying air to said start-up cell, and supplying air to the entire distributor plate and to fluidize the entire bed material;

closing the dampers associated with intermediary wind boxes, so as to form a partition cell in which the bed material remains deposited on the distributor plate, the partition cell separating the start-up cell from a main combustion cell; and operating the start-up cell and the main combustion cell at different operating conditions.

6. A method according to claim 5, wherein the start-up cell operates at a higher temperature than the main combustion cell.

7. A method according to claim 5, wherein there is only one intermediary wind box.

8. A method according to claim 5, wherein the main combustion cell may be extended by opening the damper associated with the intermediary wind box adjacent the wind box for supplying air to the main combustion cell, and supplying air to the distributor plate so as to fluidize the bed material above the open intermediary wind box, while leaving further dampers associated with further intermediary wind boxes closed.

9. A method according to claim 5, wherein the start-up cell may be extended by opening the damper associated with the intermediary wind box adjacent the wind box for supplying air to the start-up cell, and supplying air to the distributor plate so as to fluidize the bed material above the open intermediary wind box, while leaving further dampers associated with further intermediary wind boxes closed.

10. A method according to claim 5, further comprising collecting ash containing non-combusted fuel components from exhaust gas released from the main combustion cell and combusting the non-combusted fuel components in the collected ash in the start-up cell, the start-up cell operating at a higher temperature than the main combustion cell.

* * * * *